US009293288B2

(12) United States Patent
Fischer

(10) Patent No.: US 9,293,288 B2
(45) Date of Patent: Mar. 22, 2016

(54) METHOD FOR OPERATING AN ELECTRICAL APPARATUS AND CIRCUIT BREAKER

(75) Inventor: Andreas Fischer, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 735 days.

(21) Appl. No.: 13/596,451

(22) Filed: Aug. 28, 2012

(65) Prior Publication Data

US 2013/0049486 A1 Feb. 28, 2013

(30) Foreign Application Priority Data

Aug. 30, 2011 (DE) ..... 10 2011 081 773

(51) Int. Cl.

| | |
|---|---|
| ***H01H 47/00*** | (2006.01) |
| ***H01H 83/00*** | (2006.01) |
| ***H02J 7/00*** | (2006.01) |
| ***H01H 71/12*** | (2006.01) |

(52) U.S. Cl.

CPC ..... *H01H 71/125* (2013.01); *Y10T 307/911* (2015.04)

(58) Field of Classification Search

CPC ... H01H 71/125; H01H 47/00; H01H 47/002; H01H 13/06; H01H 2239/006; H01H 9/54; H01H 13/86; H01H 13/88; H01H 2215/006; H01H 2223/002; H01H 2229/036; H01H 2239/074; H01H 47/004; H01H 83/00; H01H 9/00

USPC ..... 307/125

See application file for complete search history.

(56) References Cited

U.S. PATENT DOCUMENTS

| | | | | |
|---|---|---|---|---|
| 3,622,867 | A * | 11/1971 | Topper et al. | 323/341 |
| 4,120,270 | A * | 10/1978 | Asano et al. | 123/479 |
| 4,208,689 | A | 6/1980 | Dunham | |
| 4,634,981 | A * | 1/1987 | Shimp et al. | 324/424 |
| 5,166,887 | A * | 11/1992 | Farrington et al. | 700/293 |
| 5,912,614 | A | 6/1999 | Okuya | |
| 6,347,029 | B1 * | 2/2002 | Ouyang et al. | 361/93.9 |
| 6,657,453 | B2 * | 12/2003 | Frankowsky | 324/754.03 |
| 7,561,396 | B2 * | 7/2009 | Song | 361/93.5 |
| 2008/0036561 | A1 | 2/2008 | Hartinger et al. | |

FOREIGN PATENT DOCUMENTS

| | | | |
|---|---|---|---|
| CN | 101084561 | A | 12/2007 |
| DE | 195 15 491 | A1 | 10/1996 |
| DE | 199 59 787 | A1 | 6/2001 |
| DE | 10 2006 021 444 | A1 | 10/2007 |

* cited by examiner

*Primary Examiner* — Jared Fureman
*Assistant Examiner* — Esayas Yeshaw
(74) *Attorney, Agent, or Firm* — Harness, Dickey & Pierce, P.L.C.

(57) ABSTRACT

In order to provide a high impedance between two sensor terminals, for instance for connecting a Rogowski transducer to a circuit breaker, but to prevent the coupling-in of interference signals in the case of a non-connection to the terminals, two auxiliary terminals are connected. In at least one embodiment, they are connected in such a manner that in the basic state, the sensor terminals are short circuited but in the case of a connection, for example of a plug to the sensor terminals and simultaneously to the auxiliary terminals, the short circuit is canceled with external short circuiting of the auxiliary terminals.

16 Claims, 2 Drawing Sheets

METHOD FOR OPERATING AN ELECTRICAL APPARATUS AND CIRCUIT BREAKER

PRIORITY STATEMENT

The present application hereby claims priority under 35 U.S.C. §119 to German patent application number DE 10 2011 081 773.5 filed Aug. 30, 2011, the entire contents of which are hereby incorporated herein by reference.

FIELD

At least one embodiment of the invention generally relates to a method for operating an electrical apparatus, the electrical apparatus possibly being especially a circuit breaker. At least one embodiment of the invention also generally relates to a circuit breaker.

BACKGROUND

Circuit breakers have switching contact devices for interrupting in each case a line connecting two line terminals for a (phase) line in the circuit breaker. In the case of three phase lines, there are also three switching contact devices. In the circuit breakers, there is a triggering device which can act mechanically on the switching contact devices. In the present case, the triggering device is intended to operate digitally, that is to say comprises a data processing device to which input signals are supplied. The input signals are measuring devices for measuring the current intensity of a current flowing through the lines between the line terminals. For this purpose, current transducers are provided in the circuit breakers for each phase line or the associated inner line in the circuit breaker, in the form of Rogowski transducers, coils without iron core, typically having a plastic core. The input signals generated by such Rogowski transducers are supplied to the triggering device and this is designed for driving the switching contact devices in dependence on these input signals.

Apart from the three phase conductors (or sometimes only one), there is always also a neutral conductor. Normally, no separate current transducer is provided for this.

A circuit breaker may be equipped with one or three switching contact devices and in each case a current transducer for these but does not have a switching contact device for the neutral conductor and no current transducer either. However, it should be possible to upgrade it. In this case, the circuit breaker comprises an external main terminal to which a current transducer which does not belong to the circuit breaker can be connected; thinking in this case of a current transducer, especially a Rogowski transducer, which surrounds the neutral conductor. The input signals originating from this current transducer, which is connected externally, are also intended to be supplied to the triggering device but, instead of a separate switching contact for the neutral conductor, the switching contact devices for the phase lines are driven. It is thus possible to upgrade a so-called three-pole circuit breaker, that is to say a circuit breaker without monitoring of the neutral conductor, to become a four-pole circuit breaker.

However, the facts of the matter are that it is a mark of upgradability that an external Rogowski transducer is not always connected.

Different from current transducers having an iron core, the measuring inputs of the circuit breaker must have a high impedance for the case of the Rogowski transducer being connected. In this way, however, the measuring inputs, that is to say the sensor terminals of the current measuring device, are highly susceptible for interference signals being coupled in, especially when no Rogowski transducer happens to be connected. In this case, the measuring input would be operated with both sensor terminals open, and especially in the case of the so-called ground fault detection, possible interference signals could lead to a mistriggering of the circuit breaker, that is to say to an opening of the switching contacts when this is not indicated at all.

SUMMARY

The inventors have discovered a problem that exists in that a circuit breaker, generally an electrical apparatus, must have a high internal impedance for the connection of a further apparatus to its sensor terminals but this internal impedance is disturbing when the other apparatus is not connected.

At least one embodiment of the present invention is directed to a circuit breaker wherein the problem does not exist, or generally, in at least one embodiment, providing a method for operating an electrical apparatus which solves the problems mentioned, in that different internal impedances of the electrical apparatus are required in different situations.

In one aspect, a method is disclosed, and in another aspect, a circuit breaker is disclosed.

In the method according to at least one embodiment of the invention, the electrical apparatus has two sensor terminals (or generally main terminals) and two auxiliary terminals. A connecting element is connected to the auxiliary terminals in order to short circuit these from the outside. Following this, it is effected in the apparatus that the internal impedance provided by the apparatus between the sensor terminals (or the main terminals, respectively) changes.

BRIEF DESCRIPTION OF THE DRAWINGS

In the text which follows, an example embodiment of the invention is described in greater detail with reference to the drawing, in which.

DETAILED DESCRIPTION OF THE EXAMPLE EMBODIMENTS

Figure 1:
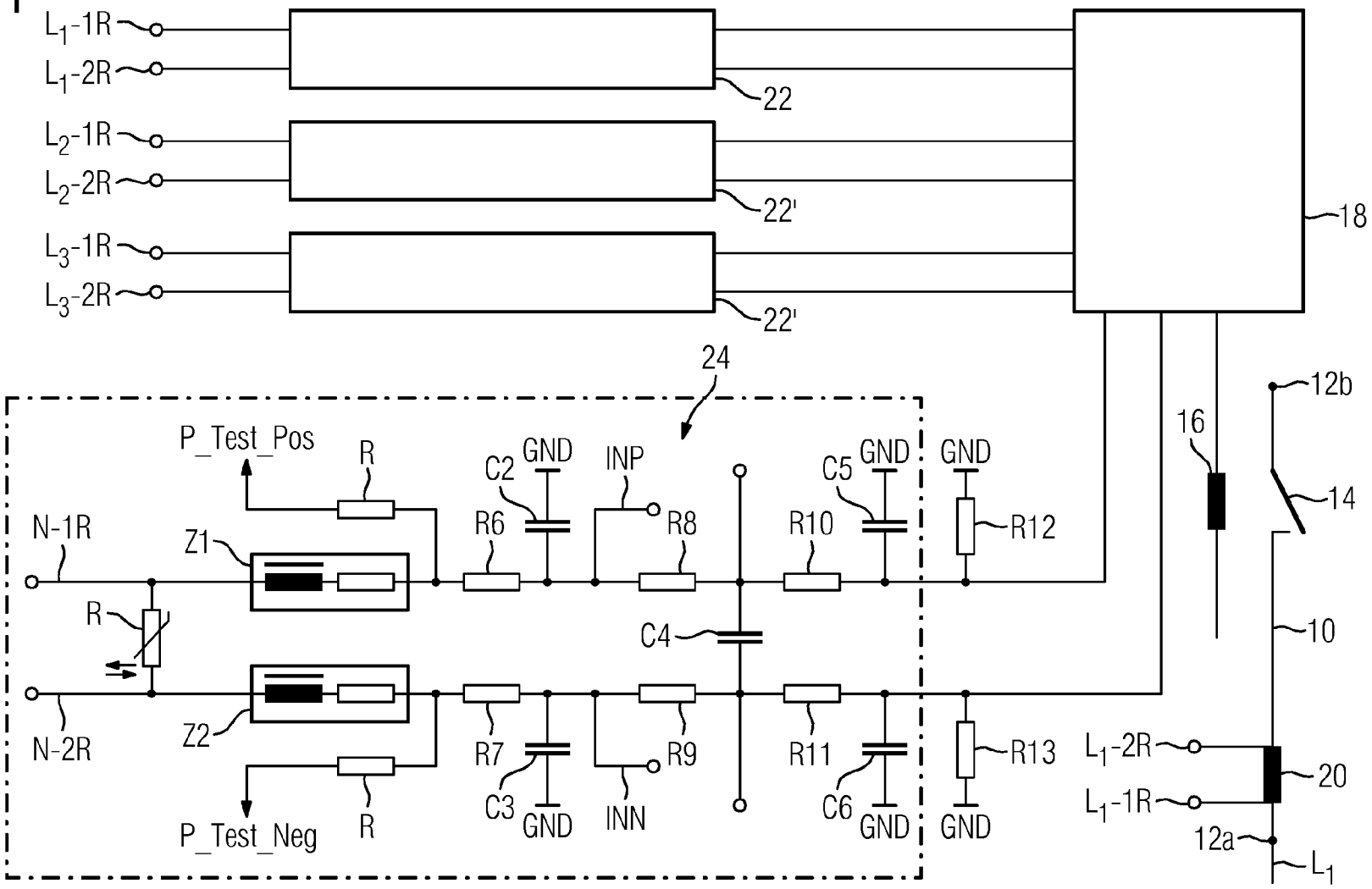
FIG. 1 illustrates the elements of a circuit breaker for understanding of an embodiment of the invention.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the present invention is directed to a circuit breaker wherein the problem does not exist, or generally, in at least one embodiment, providing a method for operating an electrical apparatus which solves the problems mentioned, in that different internal impedances of the electrical apparatus are required in different situations.

In one aspect, a method is disclosed, and in another aspect, a circuit breaker is disclosed.

In the method according to at least one embodiment of the invention, the electrical apparatus has two sensor terminals (or generally main terminals) and two auxiliary terminals. A connecting element is connected to the auxiliary terminals in order to short circuit these from the outside. Following this, it is effected in the apparatus that the internal impedance provided by the apparatus between the sensor terminals (or the main terminals, respectively) changes.

The concept of the auxiliary terminals is thus used for making the internal impedance variable between the sensor terminals. In the present case, however, the auxiliary terminals do not need to have a control signal applied to them; it is sufficient if they are simply short circuited from the outside. This measure can be implemented very easily. In the simplest case, it can be implemented by the connecting element being a plug of a device, the plug being connected simultaneously to the sensor terminals and the auxiliary terminals, especially being plugged into corresponding sockets. In this manner, a suitable choice of the plug at the apparatus, which is a Rogowski transducer in the exemplary case, ensures that without any further action by an operator, the simple connection of the plug to the sensor terminals at the same time short circuits the auxiliary terminals so that the internal impedance changes with respect to the main terminals.

Changing the internal impedance should increase preferably by connecting the connecting element to the auxiliary terminals. In this case, the variable internal impedance consists in that the internal impedance is rather low in the case of open terminals (sensor terminals and auxiliary terminals) in order to attenuate interference signals more severely and that it is rather high for the device to be connected.

It is even simpler if in a basic state, the apparatus short circuits the sensor terminals. When the connecting element is connected to the auxiliary terminals the short circuit can simply be canceled. A short circuit can be implemented easily purely mechanically or also by circuit device(s).

It is possible to provide a microswitch which produces this measure (with plugged-in plug, the microswitch has high impedance, that is to say is open. If no plug is plugged in, the microswitch is closed, that is to say of low impedance). Similarly, a relay contact can also be used which is driven via the auxiliary terminals. In one example embodiment of the invention, however, the change of the internal impedance is effected by a circuit provided on a circuit board; such a circuit board is available in any case, especially in circuit breakers, so that only a small space of about 0.5 cm2 area needs to be provided on the circuit board in order to provide corresponding circuit elements.

In an example embodiment of the method, by short circuiting the auxiliary terminals, a potential is thus changed which is present at an input of a comparator. Potentials can be changed easily by short circuiting, namely balancing the potential present at one auxiliary terminal against a potential present at the other auxiliary terminal. In particular, a comparator allows implementation of a switch-over. This is preferably effected in that an output of the comparator is coupled to one (or the) control electrode or one (or the) gate of at least one transistor. Transistors can be switched particularly rapidly, especially also in conjunction with a comparator.

The circuit breaker according to at least one embodiment of the invention has at least one switching contact device for interrupting in each case an internal line connecting two line terminals for a (phase) line in the circuit breaker and also has a triggering device which is designed for evaluating input signals, supplied to it, from current transducers which can be connected to the sensor terminals and to drive the switching contact device in dependence on these input signals in order to effect the interrupting mentioned. The circuit breaker has a pair of auxiliary terminals to at least one associated pair of sensor terminals, and the circuit breaker also has a switching device which, in a basic state with open auxiliary terminals (that is to say when nothing is connected to the auxiliary terminals), short circuits the associated pair of sensor terminals internally, that is to say in the interior of the circuit breaker, but in the case of an external short circuit of the auxiliary terminals cancels the internal short circuit for the associated sensor terminals. The switching device thus implements a preferred embodiment of the method according to the invention which is especially suitable for a circuit breaker. This applies to an increased extent when the circuit breaker has three switching contact devices for in each case one phase line, associated line terminals and main terminals for these phase lines to which in each case a current transducer is connected which belongs to the circuit breaker. Furthermore, there are two additional sensor terminals for connecting a current transducer allocated to a neutral line, which does not belong to the circuit breaker. A pair of auxiliary terminals with the switching device is then allocated to the additional sensor terminals. This ensures that the current transducer allocated to the neutral line can be but does not have to be subsequently connected without there being any problems with the coupling-in of interference signals.

The example embodiments of how the method according to the invention can be implemented in the circuit breaker have already been mentioned for this method. Here, too, it holds true that the switching device preferably provides two different electrical potentials which in each case lead via a resistor to one of the auxiliary terminals, in addition a capacitor also being possibly provided at one of the potentials. One of the auxiliary terminals is coupled to the input of a comparator. When the two auxiliary terminals are short circuited, the two electrical potentials compete with one another so that a voltage division is effected via the resistors; with an additional capacitor, the latter is charged and a corresponding voltage occurs at the auxiliary terminal coupled to the comparator, and thus also at the input of the comparator.

Here, too, the output of the comparator is preferably coupled to a control electrode or to a gate of at least one transistor, preferably of two series-connected transistors.

A circuit breaker has so-called switching contact units which handle the actual task of the circuit breaker, namely the interrupting of a conductive connection. For this purpose, a corresponding line is carried through the circuit breaker, i.e. a line terminal is provided at the input end and a line terminal is provided at the output end and an internal line in the circuit breaker connects the line terminals. Such an internal line 10 is shown presently in exemplary manner in FIG. 1 comprising symbolically shown line terminals 12*a* and 12*b* to which a conductor L1 is connected externally. The internal line 10 has the actual switching contact which is designated by 14 and is operated, for example, by an electromagnetic trip (Maglatch) 16. The electromagnetic trip 16 is driven by a trigger unit 18 which receives measurement signals and determines in dependence on these measurement signals when the switching contact 14 is to be opened. A three-pole circuit breaker has three such arrangements with internal line 10, line terminals 12*a*, 12*b* and switching contact 14 and associated electromagnetic trip 16, only a single one being shown at present for reasons of clarity.

In the circuit breaker, a so-called Rogowski transducer 20 is provided, an air-core coil or a coil wound over a plastic element which surrounds the internal conductor 10 between the line terminals 12*a* and 12*b*. Current is induced into the Rogowski transducer 20 and the terminals L1-1R and L1-2R of the Rogowski transducer 20 lead to a first evaluating device 22 (see the same terminals L1-1R and L2-2R at the top left in FIG. 1), where they are processed before they are supplied to the triggering device 18.

Corresponding Rogowski transducers are also present for the other internal lines and correspondingly there are also other evaluating devices 22' and 22" for these.

In the present text, the circuit breaker is intended to be a three-pole circuit breaker, that is to say having three switching devices for in each case the individual phase lines L1, L2 and L3. The neutral conductor N, in contrast, is carried through the circuit breaker without being interruptible with the aid of a switching contact. It may then be desirable to provide a Rogowski transducer also with a neutral conductor, to have its signals processed and correspondingly provide a triggering of the switching contact devices 14, 16 at one of the phase conductors or a number of these. For this reason, an upgradability is provided in the circuit breaker to the extent that it also has a second evaluating device 24 to which a Rogowski transducer can be connected via terminals N-1R and N-2R, which transducer is carried around the neutral conductor outside the circuit breaker.

An embodiment of the present invention deals with the problem that, for the Rogowski transducer which is to be connected, the second evaluating device 24 must have a high impedance, that is to say have a high internal impedance for the Rogowski transducer. On the other hand, the situation must also be taken into account that no Rogowski transducer is connected to the terminals N-1R and N-2R and the terminals remain open; it should then not be possible for interference signals to be coupled in and possibly cause the circuit breaker to be tripped, that is to say a switching contact 14 of a switching contact device 14, 16 to be opened.

Figure 2:
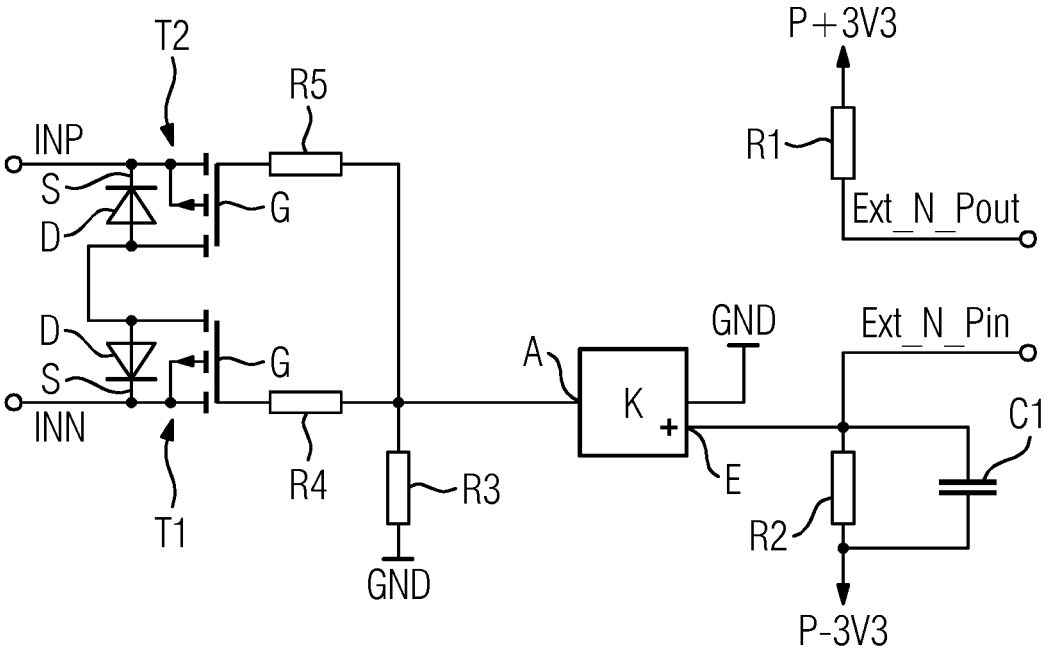
FIG. 2 shows a circuit, belonging to the circuit breaker of FIG. 1, which is provided in the context of an embodiment of the invention.
Figure 3:
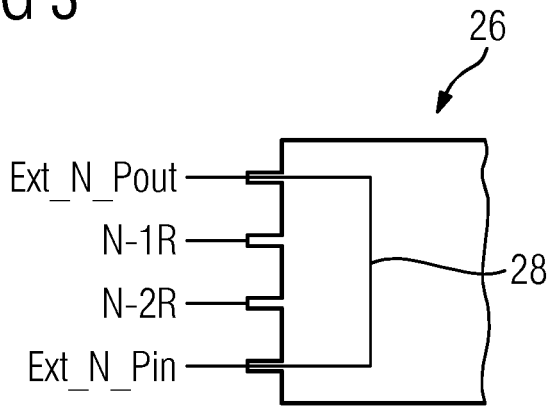
FIG. 3 illustrates in diagrammatic form a plug used in the method according to an embodiment of the invention.

For this reason, a pair of taps INP and INN is provided in the interior of the second evaluating device 24 to which pair the circuit shown in FIG. 2 is connected. As will be explained in detail in the text which follows, this circuit enables the INP and INN terminals to be short circuited in order to provide for a low impedance; the short circuit is canceled as soon as a particular plug 26, explained in the text which follows with reference to FIG. 3, is plugged into corresponding terminal sockets.

A Rogowski transducer, with the aid of which the circuit breaker can be upgraded, includes the terminals N-1R and N-2R in the plug 26.

The terminals N-1R and N-2R are connected to the counterpiece of the same name according to FIG. 1. The terminals Ext_N_Pin and Ext_N_Pout are to be connected to the terminals of the same name of the circuit from FIG. 2, for which purpose the sockets at the plug 26 must be constructed to fit the corresponding sockets at the circuit breaker. In the plug 26, the terminals Ext_N_Pin and Ext_N_Pout are short circuited externally by an internal conductor 28 in the plug 26.

In the present case, the external short circuit at terminals Ext_N_Pin and Ext_N_Pout causes the internal short circuit between terminals INP and INN to be canceled.

The internal short circuit occurs as follows: The circuit according to FIG. 2 contains that a potential of 3.3 V which is coupled to the terminal Ext_N_Pout via a resistor R1 is provided, on the one hand. Furthermore, a potential of the same amount but the opposite sign, that is to say of −3.3 V, is provided which is coupled to the terminal Ext_N_Pin via a resistor R2 and a capacitor C1 connected in parallel therewith. The terminal Ext_N_Pin is also coupled at the same time to the positive input E of a comparator K which is connected to ground (GND) with its other terminal. The output A of the comparator is coupled to ground by a resistor R3. But it is essential that it is also coupled to the gate of a first transistor T1 (p-channel MOSFET) by a resistor R4, the source S of which transistor is connected to the tap INN, and that, at the same time, the output A of the comparator K is coupled to the gate of a transistor T2 (p-channel MOSFET), the source S of which is connected to the tap INP, via a resistor R5.

In the basic state in which no plug of the type of plug 26 is connected to the terminals Ext_N_Pin and Ext_N_Pout, the potential of −3.3 V is essentially present at input E of the comparator K. The two p-channel MOSFETs T1 and T2 are then switched to low impedance, i.e. the desired short circuit between the taps INN and INP is present. When this short circuit is present, an only very low impedance, which is determined by elements Z1, Z2 and resistors R6, R7, is also present between terminals N-1R and N-2R.

If then the plug 26 is plugged in so that the terminals Ext_N_Pin and Ext_N_Pout are short circuited, resistors R1 and R2 produce a voltage division and with a suitable choice of the resistance values of these resistors (e.g. 5.6 kΩ for R1 and 20 kΩ for R2) and with a suitable choice of the capacity of the capacitor C1 of, e.g., 10 nF, the potential of 3.3 V is essentially present at the input E which leads to transistors T1 and T2 being cut off and the short circuit being canceled.

The transistors produce such a high impedance which, together with other elements R8, R9, C4, R10, R11 and also C5, C6, R12, R13, leads to the input impedance present between terminals N-1R and N-2R being sufficiently high for a Rogowski transducer.

By way of at least one embodiment of the invention, the concept is thus realized to short circuit two terminals Ext_N_Pin and Ext_N_Pout of an apparatus, namely of the circuit breaker in the present context, and thus to provide a change in impedance for two other terminals N1-R and N-2R. The terminals Ext_N_Pin and Ext_N_Pout are thus auxiliary terminals, as it were, which provide for a change in impedance with respect to the sensor terminals N-1R and N-2R.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for operating an electrical apparatus including two sensor terminals and two auxiliary terminals, the method comprising:

connecting a connecting element to the two auxiliary terminals to i) short circuit the two auxiliary terminals through the connecting element, and ii) increase an internal impedance provided by the electrical apparatus between the two sensor terminals.

2. The method of claim 1, wherein, in a basic state, the apparatus short circuits the sensor terminals and when the connecting element is connected to the auxiliary terminals, the short circuit of the two sensor terminals is canceled.

3. The method of claim 1, wherein the connecting element is a plug of a device, and if the plug is connected the two auxiliary terminals, the plug is connected simultaneously to the two sensor terminals.

4. The method of claim 1, wherein, by short circuiting the two auxiliary terminals, a potential is changed which is present at an input of a comparator.

5. The method of claim 4, wherein an output of the comparator is coupled to a control electrode or the gate of at least one transistor.

6. A circuit breaker, comprising:

at least one switching contact device, configured to interrupt an internal line connecting two line terminals for a line in the circuit breaker; and a triggering device, configured to evaluate input signals, supplied to the triggering device, from current transducers to drive the at least one switching contact device based on the input signals;

a pair of auxiliary terminals and at least one pair of associated sensor terminals; and a switching device configured to, i) in a basic state where the pair of auxiliary terminals are open, short circuit the associated pair of sensor terminals internally and, ii) in the case of the pair of auxiliary terminals being short-circuited, cancel the short circuit for the associated sensor terminals to increase an internal impedance provided by the switching device between the sensor terminals.

7. The circuit breaker of claim 6, wherein the at least one switching contact device includes three switching contact devices wherein, in each case, one phase line with associated line terminals and sensor terminals to which, in each case, a current transducer of the circuit breaker is connected, and further comprising two additional sensor terminals configured to connect a current transducer allocated to a neutral line, outside the circuit breaker, and an additional pair of auxiliary terminals allocated to the additional sensor terminals.

8. The circuit breaker of claim 6, wherein the switching device is configured to provide two different electrical potentials which are, in each case, coupled by a resistor to one of the pair of auxiliary terminals, and wherein one of the pair of auxiliary terminals is coupled to the input of a comparator.

9. The circuit breaker of claim 8, wherein the output of the comparator is coupled to a control electrode or to the gate of at least one transistor.

10. The method of claim 2, wherein the connecting element is a plug of a device, and if the plug is connected to the two auxiliary terminals, then the plug is connected simultaneously to the two sensor terminals.

11. The method of claim 2, wherein, by short circuiting the two auxiliary terminals, a potential is changed which is present at an input of a comparator.

12. The method of claim 11, wherein an output of the comparator is coupled to a control electrode or the gate of at least one transistor.

13. The circuit breaker of claim 7, wherein the switching device is configured to provide two different electrical potentials which are, in each case, coupled by a resistor to one of the pair of auxiliary terminals, and wherein one of the pair of auxiliary terminals is coupled to the input of a comparator.

14. The circuit breaker of claim 13, wherein the output of the comparator is coupled to a control electrode or to the gate of at least one transistor.

15. The circuit breaker of claim 9, wherein the at least one transistor includes two series-connected transistors.

16. The circuit breaker of claim 14, wherein the at least one transistor includes two series-connected transistors.

* * * * *